US006402059B1

(12) United States Patent
Benz et al.

(10) Patent No.: US 6,402,059 B1
(45) Date of Patent: Jun. 11, 2002

(54) FUEL LANCE FOR SPRAYING LIQUID AND/OR GASEOUS FUELS INTO A COMBUSTION CHAMBER, AND METHOD OF OPERATING SUCH A FUEL LANCE

(75) Inventors: Urs Benz, Gipf-Oberflick (CH); Franz Joos, Weilheim-Bannholz (DE)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/503,711

(22) Filed: Feb. 14, 2000

(30) Foreign Application Priority Data

Feb. 15, 1999 (DE) ..... 199 05 995

(51) Int. Cl.[7] ..... F23D 14/22

(52) U.S. Cl. ..... 239/422; 239/424; 239/549; 431/8

(58) Field of Search ..... 431/8, 187, 10; 239/418, 422, 424, 428, 424.5, 549; 60/742

(56) References Cited

U.S. PATENT DOCUMENTS

| | | | | | |
|---|---|---|---|---|---|
| 1,452,020 | A | * | 4/1923 | Atkins | 239/424 |
| 3,777,983 | A | * | 12/1973 | Hibbins | 239/422 |
| 3,826,080 | A | * | 7/1974 | De Corso et al. | 60/742 |
| 4,451,230 | A | * | 5/1984 | Bocci et al. | 431/183 |
| 4,566,268 | A | * | 1/1986 | Hoffeins et al. | 60/742 |
| 4,850,195 | A | * | 7/1989 | Ohkubo et al. | 60/738 |
| 4,932,861 | A | | 6/1990 | Keller et al. | |
| 5,361,578 | A | | 11/1994 | Donlan | |
| 5,431,018 | A | | 7/1995 | Keller | |
| 5,487,659 | A | | 1/1996 | Eroglu et al. | |
| 5,626,017 | A | | 5/1997 | Sattelmayer | |
| 5,785,721 | A | * | 7/1998 | Brooker | 239/422 |
| 5,833,141 | A | | 11/1998 | Bechtel, II et al. | |

FOREIGN PATENT DOCUMENTS

| | | | |
|---|---|---|---|
| DE | 4326802 | A1 | 2/1995 |
| EP | 0 071 420 | A1 | 2/1983 |
| EP | 0 071 420 | | 2/1983 |
| EP | 0321809 | B1 | 5/1991 |
| EP | 0620362 | A1 | 10/1994 |
| GB | 2283088 | A | 4/1995 |
| JP | 0620166210 | | 7/1987 |
| JP | 0020267406 | | 11/1990 |
| JP | 0060066156 | | 3/1994 |
| JP | 0110062622 | | 3/1999 |

OTHER PUBLICATIONS

U.S. Patent Application Serial No. 09/503,709, filed Feb. 14, 2000; Inventors: Urs Benz, et al.
UK Search Report dated Aug. 11, 2000.

* cited by examiner

*Primary Examiner*—Sara Clarke
(74) *Attorney, Agent, or Firm*—Burns, Doane, Swecker & Mathis, L.L.P.

(57) ABSTRACT

In a fuel lance for spraying liquid and/or gaseous fuels into a combustion chamber, which fuel lance is part of a secondary or tertiary burner, around which a hot-gas jet flows in a main flow direction, and comprises a liquid-fuel passage for supplying liquid fuel and first means for spraying the liquid fuel from the liquid-fuel passage into the combustion chamber, operation characterized by reduced addition of water is made possible owing to the fact that the first means comprise a liquid-fuel nozzle, which sprays the liquid fuel essentially parallel to the main flow direction as a plain jet into the combustion chamber.

13 Claims, 1 Drawing Sheet

FUEL LANCE FOR SPRAYING LIQUID AND/OR GASEOUS FUELS INTO A COMBUSTION CHAMBER, AND METHOD OF OPERATING SUCH A FUEL LANCE

FIELD OF THE INVENTION

The present invention relates to fuel lance apparatus and methods for spraying liquid and/or gaseous fuels into a combustion chamber, particularly as used in gas turbines.

BACKGROUND OF THE INVENTION

Publication DE-A1-43 26 802 discloses a fuel lance which is at present used by the applicant in his gas turbines (in this respect see also publications U.S.Pat. No. 5,431,018, U.S. Pat. No. 5,626,017 and EP-A1-0 620 362). In this case, the nozzles for gaseous fuel and liquid fuel (oil, etc.) are combined.

The development of the oil spraying of the primary burners (EV burners) led to the plain-jet principle. In this case, the liquid fuel is sprayed as a jet through a central bore into the burner. The fuel jet disintegrates in the swirl zone of the EV burner (in this respect see, for example, EP-B1-0 321 809). Depending on the adaptation of the impulse ratio between the liquid-fuel jet and the surrounding air flow, the location of the jet disintegration can be set.

The known radial spraying of the liquid fuel of the SEV chamber and the atomizing of the liquid fuel by means of an air-blast nozzle leads to a relatively large quantity of water having to be admixed with the liquid-fuel spray jet in order to prevent a flame flashback.

SUMMARY OF THE INVENTION

The object of the invention is therefore to provide a fuel lance for the spraying of liquid fuel and/or gaseous fuel in a secondary or tertiary burner, which fuel lance avoids the above-described disadvantages of previous lances and permits in particular a reduction in the retention time of the liquid fuel in the premix section and thus a reduction in the admixed proportion of water.

The essence of the invention consists in spraying the liquid fuel axially in the main flow direction by means of a plain-jet nozzle. The result of this type of spraying is that the retention time of the liquid fuel in the premix section is reduced and thus less water has to be added in order to prevent a flame flashback.

A first preferred embodiment of the fuel lance according to the invention is comprises a central liquid-fuel tube, which is arranged concentrically to a lance axis and encloses the liquid-fuel passage for directing a liquid fuel, and a gas tube, which encloses the liquid-fuel tube and forms between it and the liquid-fuel tube a gas passage for directing a gaseous fuel, and a lance shell, which encloses the gas tube and forms between it and the gas tube an air passage for directing cooling or atomizing air, and also second means for spraying the gaseous fuel from the gas passage into the combustion chamber, and third means for spraying the air from the air passage into the combustion chamber, the lance axis being oriented essentially parallel to the main flow direction. This permits a flexible mode of operation with different fuels or fuel combinations in a compact construction.

The axial liquid-fuel jet of the fuel lance according to the invention is preferably surrounded by an air veil. This is achieved in a second embodiment of the invention in that the liquid-fuel nozzle is arranged centrally in the lance axis, and in that the third means comprise first nozzle means which are designed in such a way that the liquid-fuel jet discharging axially through the liquid-fuel nozzle is surrounded in a sheath-like manner by a likewise axially discharging air veil, either the first nozzle means comprising a plurality of axially oriented bores which are arranged in a distributed manner around the liquid-fuel nozzle, or the first nozzle means comprising an annular gap which concentrically surrounds the liquid-fuel nozzle.

The air for the air veil around the liquid-fuel jet is preferably utilized at least for the partial cooling of the lance head. This is done in a development of the second embodiment of the invention by the first nozzle means or bores or the annular gap being connected to the air passage via a head passage, running through the lance head, in such a way that the lance head is cooled by the air flowing in the head passage.

In a further preferred embodiment of the invention, the gaseous fuel from the gas passage is sprayed radially into the combustion chamber through individual nozzle openings oriented radially to the lance axis, the gas jet from the nozzle openings in each case being surrounded concentrically by an air sheath, and the nozzle openings for the gaseous fuel in each case being formed by a radially arranged guide tube, which is connected to the gas passage and opens into the combustion chamber through a shell opening in the lance shell, and the shell opening, relative to the outside diameter of the guide tube, being selected in such a way that an annular gap remains free for producing the air sheath surrounding the gas jet.

A lance according to another preferred embodiment has an especially simple geometry. The gaseous fuel is sprayed concentrically to the liquid fuel as a plain jet essentially parallel to the main flow direction. The two fuel jets are concentrically surrounded by an air sheath. A first annular gap, which concentrically surrounds the liquid-fuel nozzle, is provided for spraying the gaseous fuel. A second annular gap, which concentrically surrounds the first annular gap, is provided for forming the air sheath.

The method according to the invention for operating such a fuel lance is characterized in that in each case liquid fuel is sprayed into the combustion chamber through the liquid-fuel nozzle and air is sprayed into the combustion chamber through each of the first and second annular gaps.

Furthermore, it is conceivable for the axial part, formed parallel to the main flow direction, of the fuel lance to be shortened if the inflowing swirl zone (of the hot gases) is configured in such a way that no wake zone occurs. An embodiment of the lance in which the liquid fuel is sprayed directly at the radial holder or supporting arm is therefore also conceivable (4 in FIG. 1 of DE-A1-43 26 802). This stem may be designed to be profiled in a more or less fluidically favorable manner. According to the invention, the preferred spraying is effected axially via a plain jet, and accordingly perpendicularly to the main flow direction for the air-sheathed gaseous fuel. This embodiment has the advantage that the lance is easier to fit and requires less cooling air.

BRIEF DESCRIPTION OF THE DRAWINGS

Preferred embodiments of the invention are illustrated in the accompanying drawings, in which.

DETAILED DESCRIPTION OF THE INVENTION

Figure 1:
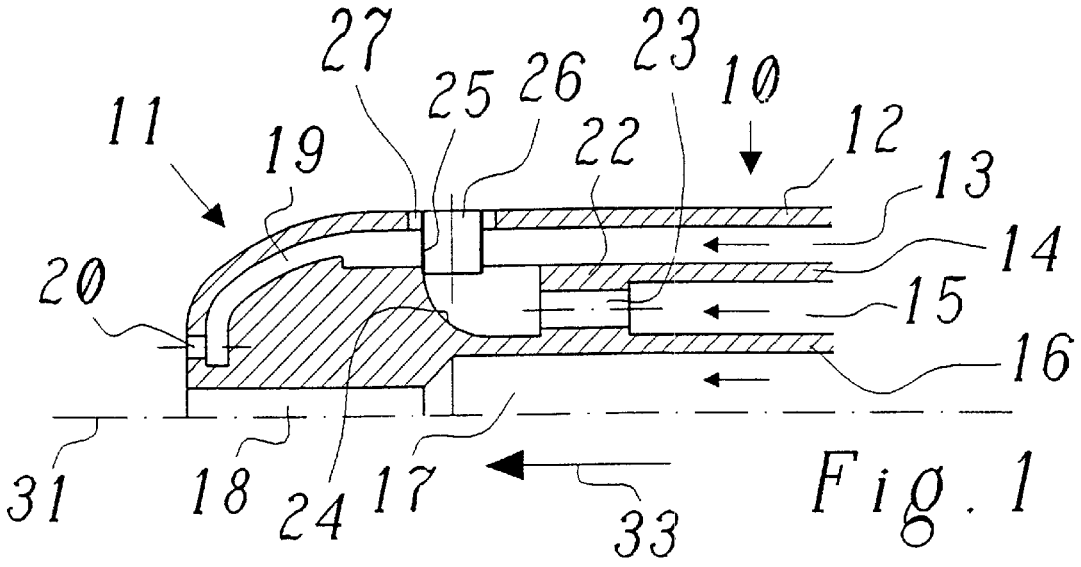
FIG. 1 shows a longitudinal section of the head region of a fuel lance in a preferred embodiment of the invention, with radial spraying of the gaseous fuel by a gas jet which is formed axially and is then deflected at right angles into a radial guide tube and has air sheathing.

A preferred embodiment of a fuel lance according to the invention is shown in longitudinal section in FIG. 1. The fuel lance 10, which extends along a lance axis 31, which in turn lies essentially parallel to the main flow direction 33 of a hot-gas flow flowing around the lance, is shown in FIG. 1 only with its head region. A liquid-fuel tube 16, a gas tube 14 and a lance shell 12 are arranged one inside the other in the fuel lance 10 concentrically to the lance axis 31. The interior of the liquid-fuel tube 16 forms a liquid-fuel passage 17, through which liquid fuel, in particular oil or the like, is directed for spraying in the direction of the depicted arrow into the lance head 11. Formed between the liquid-fuel tube 16 and the gas tube 14 is a gas passage 15, through which gaseous fuel is directed in the direction of the depicted arrow for spraying into the lance head 11. Finally, an air passage 13, through which air is directed into the lance head 11 in the direction of the depicted arrow, is formed between the gas tube 14 and the lance shell 12.

According to the invention, the liquid fuel is sprayed axially in the form of a plain jet into the combustion chamber, into which the fuel lance 10 projects. To this end, the liquid-fuel passage 17 narrows in the lance head 11 to form an axial liquid-fuel nozzle 18. The liquid-fuel jet discharging from the liquid-fuel nozzle 18 is preferably sheathed (surrounded) with an air veil. To this end, axial bores 20, through which air can discharge in the axial direction and surround the liquid-fuel jet, are arranged around the liquid-fuel nozzle 18 on a concentric ring. The air required for this purpose is fed in from the air passage 13 via a head passage 19, which runs in the marginal region through the lance head 11. This achieves the effect that the lance head 11 is also cooled by the air flowing through.

In the exemplary embodiment in FIG. 1, the gaseous fuel is sprayed from the gas passage 15 radially to the lance axis 31 and thus radially to the main flow direction 33 into the combustion chamber. The gas passage 15 is closed by a closure ring 22 before reaching the lance head 11. Provided in the closure ring 22 around the lance axis 31 are axial bores 23, through which the gaseous fuel discharges in the form of axial fuel jets. In a following curved deflecting surface 24, the axial fuel jets are deflected outward at right angles and then in each case enter a radial guide tube 25, which directs the jet outward unhindered by the air passage 13. The guide tubes 25, in their orifice region, at the same time form the nozzle openings 26 for the radially sprayed gaseous fuel. So that the guide tubes 25 can open into the combustion chamber, corresponding shell openings 27, through which the guide tubes 25 pass, are provided in the lance shell 12. The shell openings 27, relative to the outside diameter of the respective guide tube 25, are selected in such a way that an annular gap remains free for producing a protective air sheath surrounding the gas jet.

Figure 2:
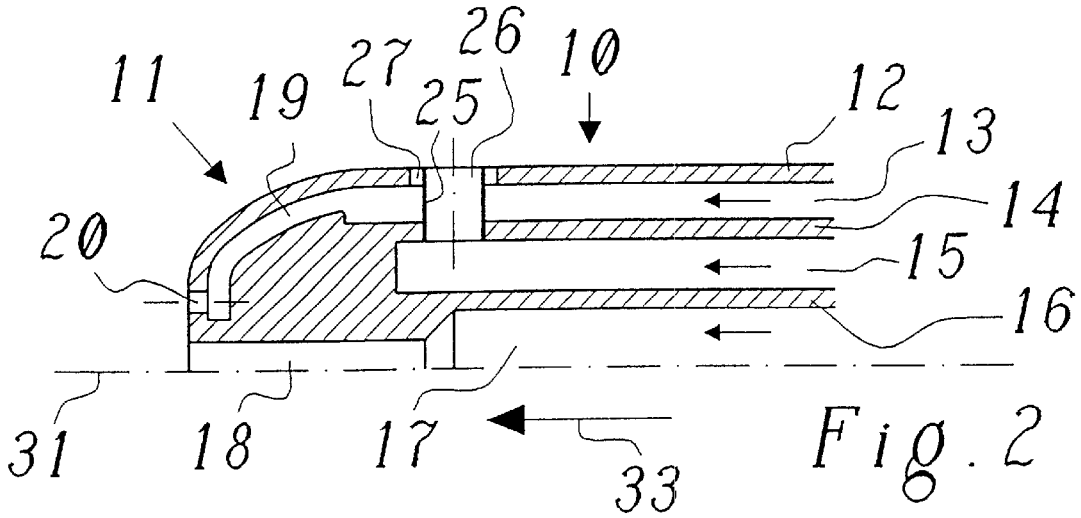
FIG. 2 shows a longitudinal section of a modified form of the embodiment analogous to FIG. 1, in which the radial gas jet is formed directly by the guide tube proceeding radially from the gas tube.

A modified form of the embodiment of FIG. 1 is shown in FIG. 2. Here, the radial jets of the air-sheathed gaseous fuel are formed in a slightly different way. To this end, the gas passage 15 is directed right into the lance head 11 and ends there. The guide tubes 25, which in this case too cross the air passage 13 and open into the combustion chamber through corresponding shell openings 27 in a manner flush with the lance shell 12 and form the nozzle openings 26, are directly attached to the gas tube 14, so that axial bores and deflecting surfaces may be dispensed with. This results in a simplified construction of the fuel lance 10. The liquid fuel is sprayed and sheathed with air in FIG. 2 in the same way as in FIG. 1.

Figure 3:
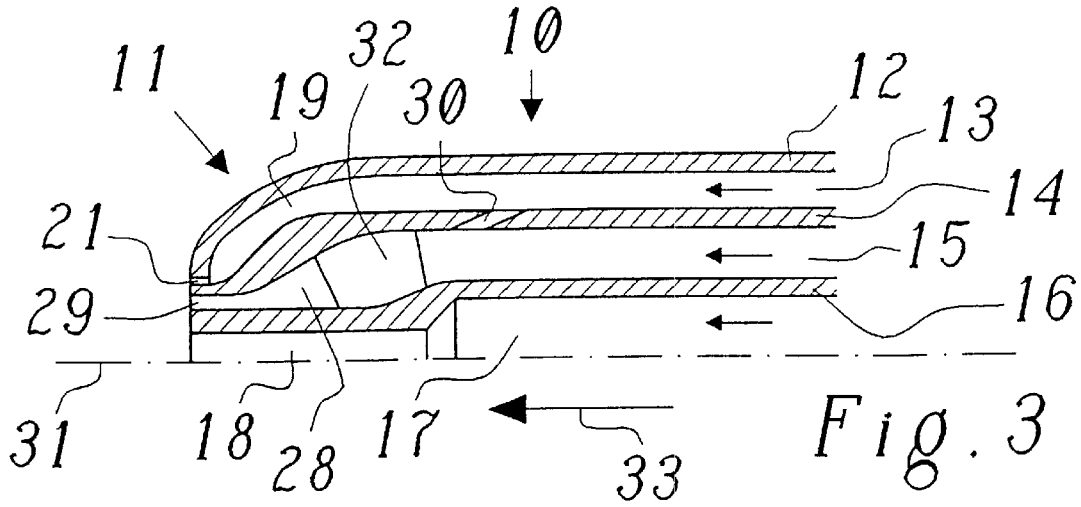
FIG. 3 shows a longitudinal section of the head region of a fuel lance in a second modified form of the preferred embodiment of FIG. 1 with axial gaseous-fuel spraying concentric to the liquid fuel jet and concentric air sheathing of both fuel jets.

However, it is also conceivable for the air-sheathed gas jet to be made axially, and not radially, in the form of a plain jet. A second modified form of the embodiment in FIG. 3. In this case, the liquid-fuel feed, gas feed and air feed are constructed concentrically top the lance, axis. The liquid-fuel nozzle 18 is located in the center. The liquid-fuel nozzle 18 is concentrically surrounded by a first annular gap 29, through which gaseous fuel is sprayed axially. The gaseous fuel is fed in from the gas passage 15 via a connecting passage 28, in which connecting webs 32 may be arranged for the mutual support of the tubes. The first annular gap 29 is concentrically surrounded by a second annular gap 21, through which an air sheath is sprayed axially and surrounds the two fuel jets (such an annular gap may incidentally also be used in FIGS. 1 and 2 instead of the bores 20). Furthermore, in the configuration according to FIG. 3, a connection between air passage 13 and gas passage 15 in the form of connecting bores 30 may be provided. As a result, it is possible to maintain the spraying impulse of the gas jet even during part-load mass fuel flows by the reduced fuel quantity being replaced by additional air. In addition, during liquid-fuel operation of the fuel lance according to FIG. 3, it is conceivable for air to also be admitted to the first annular gap 29 (i.e. the gas nozzle).

On the whole, the invention results in a fuel lance which leads to a reduced demand for added water. In this case, the gas spraying may be effected radially (FIGS. 1, 2) or axially (FIG. 3) or also at other angles to the main flow direction 33, specifically with one or more jets. Pure gas- or liquid-fuel lances are also conceivable. Finally, the axial part, formed parallel to the main flow direction, of the fuel lance may be shortened if the inflowing swirl zone (of the hot gases) is configured in such a way that no wake zone occurs. An embodiment of the lance in which the liquid fuel is sprayed directly at the radial holder is therefore also conceivable. This stem may be designed to be profiled in a more or less fluidically favorable manner. In this case, the preferred spraying is effected axially via a plain jet, and accordingly perpendicularly to the main flow direction for the air-sheathed gaseous fuel. This embodiment has the advantage that the lance is easier to fit and requires less cooling air.

What is claimed is:

1. A fuel lance for spraying liquid and/or gaseous fuels into a combustion chamber, the fuel lance comprising a liquid fuel passage for supplying liquid fuel and a liquid-fuel nozzle for spraying the liquid fuel from the liquid-fuel passage that extends essentially parallel to the main flow direction of the liquid fuel and out of the passage as a plain jet into a combustion chamber, the liquid-fuel nozzle having a plurality of axially oriented bores which are arranged in a distributed manner around the liquid-fuel nozzle, including a central liquid-fuel tube, which is arranged concentrically to a central axis of the lance, and which encloses the liquid-fuel passage a lance shell, a gas tube which encloses the liquid-fuel tube and forms between the lance shell and the gas tube an air passage for directing cooling or atomizing air, and including second means for spraying the gaseous fuel from the gas tube into a combustion chamber, and including third means for spraying air from the air passage into a combustion chamber, the lance axis being oriented essentially parallel to the main flow direction, the third means includes a nozzle arranged to form a sheath of air surrounding liquid-fuel discharging from the liquid-fuel nozzle.

2. The fuel lance as claimed in claim 1, wherein the fuel lance has an annular gap which concentrically surrounds the liquid-fuel nozzle.

3. The fuel lance as claimed in claim 1, wherein the lance includes a head passage, running through the lance head for cooling the lance by the air flowing in the head passage.

4. The fuel lance as claimed in claim 1, wherein the gaseous fuel from the gas passage is sprayed radially into the combustion chamber through individual nozzle openings oriented radially to the lance axis.

5. The fuel lance as claimed in claim 1, wherein the fuel lance includes a plurality of individual nozzle openings oriented radially to the central axis of the lance for directing air from the air passage radially from the nozzle openings, nozzle openings being in each case surrounded concentrically by an air sheath.

6. The fuel lance as claimed in claim 5, wherein the nozzle openings for the gaseous fuel are in each case formed by a radially arranged guide tube, which is connected to the gas passage and opens into the combustion chamber through a shell opening in the lance shell, and in that the shell opening, relative to the outside diameter of the guide tube, is selected in such a way that an annular gap remains free for producing the air sheath surrounding the gas jet.

7. The fuel lance as claimed in claim 6, wherein the gas passage is closed by a closure ring at its end facing the lance head, in that the closure ring in the region of the guide tubes is in each case provided with an axial bore for the passage of the gaseous fuel, and in that the gaseous fuel jet flowing out of the bores is in each case deflected by means of a deflecting surface into the guide tube.

8. The fuel lance as claimed in claim 6, wherein the gas passage extends through the lance and terminates at the lance head and wherein the guide tubes are each attached directly to the gas tube.

9. The fuel lance as claimed in claim 1, wherein the second means includes a gas nozzle arranged as a plain jet essentially parallel to the central axis of the lance and wherein the third nozzle is arranged concentrically of the lance axis so that the gaseous fuel is sprayed from the gas nozzle and air is sprayed from the third nozzle to form an air sheath concentrically surrounding the gaseous fuel from the gas nozzle and the liquid fuel spray from the liquid fuel nozzel.

10. The fuel lance as claimed in claim 9, wherein a first annular gap, which concentrically surrounds the liquid-fuel nozzle, is provided for spraying the gaseous fuel, and wherein a second annular gap, which concentrically surrounds the first annular gap, is provided for forming the air sheath.

11. The fuel lance as claimed in claim 9, wherein connecting bores are provided between the air passage and the gas passage and permit the spraying of a partial flow of the air into the mass flow of the gaseous fuel.

12. A method of operating a fuel lance having a central tubular passage comprising conducting liquid fuel axially along the central tubular passage in a main flow direction, the central tubular passage being a first path, spraying the liquid fuel into a combustion chamber through a plain jet nozzle, conducting air along a second predetermined path, independent of the first path, conducting gaseous fuel along a third predetermined path, spraying air into the combustion chamber through an annular nozzle surrounding the plain jet nozzle thereby forming a sheath of air around the liquid fuel spray, wherein the second and third paths are concentric of the first path.

13. The method to claim 12, wherein the first path is substantially straight.

* * * * *